United States Patent [19]

Deal

[11] 4,142,411

[45] Mar. 6, 1979

[54] WATER WELL DRAW DOWN MONITORING SYSTEM

[75] Inventor: Clarence D. Deal, Oklahoma City, Okla.

[73] Assignee: Electromeasures, Inc., Ennis, Tex.

[21] Appl. No.: 816,970

[22] Filed: Jul. 19, 1977

[51] Int. Cl.[2] ..... E21B 47/04

[52] U.S. Cl. ..... 73/155

[58] Field of Search ..... 73/155, 389, 391, 73, 73/76, 38, 151, 155; 166/250

[56] References Cited

U.S. PATENT DOCUMENTS

| | | | |
|---|---|---|---|
| 3,877,301 | 4/1975 | Jensen, Jr. | 73/155 |
| 3,991,611 | 11/1976 | Marshall et al. | 73/151 |

*Primary Examiner*—Jerry W. Myracle

*Attorney, Agent, or Firm*—Bacon & Thomas

[57] ABSTRACT

A method and apparatus for measuring the draw down of a water well by making in situ measurements of the static and dynamic water table levels. A well bore located pressure sensor provides the hydrostatic pressures to a surface located electronic measuring unit which provides a draw down measurement directly in terms of feet of water. An extension of the method provides for combining the measured draw down parameter with water discharge pressure and water flow measurements to derive a set of data which uniquely characterizes the production capability of the well. The apparatus performs all measurements automatically and has provisions for producing a time history of the well parameters, and telemetering to a central station for monitoring and processing.

10 Claims, 2 Drawing Figures

WATER WELL DRAW DOWN MONITORING SYSTEM

BACKGROUND OF THE INVENTION

The present invention relates to a method and apparatus for determining the draw down characteristics of a well. More particularly, the invention relates to a technique wherein both static and dynamic water table levels are measured by means of an absolute pressure transducer immersed in the bore hole, independent of any casing or tubing structure, and a direct reading measuring circuit located at the surface is used to derive the draw down of the well. The draw down data is then used in conjunction with water pressure and water flow data to provide a monitoring system for water wells.

One of the tests that is paramount to determining the productivity of a water well is measuring the influx of water to the well during pumping. The influx is directly indicative of the ability of the surrounding soil formation to give up the water it contains. Poor water producing formations may contain a plentiful reservoir of water but yield it at rates which render wells located therein of low productivity. While the water well industry has long been aware of the importance of draw down as a key factor indicating the quality of a well, the methods for measuring it have remained largely manual. Two other factors which are well known as being required to evaluate the influx of a well are the discharge pressure and volume of flow of the water being produced. As a result of the relative difficulty of having a measuremment of well draw down quickly and easily available, there is a tendency to overlook the importance of having frequent measurements of the parameter. A number of foreign countries have rigid requirements calling for measurements of a water well's productivity upon completion of drilling. In addition to the importance of having the influx characteristics of a well known for evaluating the production quality, the three factors mentioned above are also invaluable for making rapid and accurate diagnosis of fault symptoms, and for planning of preventive maintenance of the well and its facilities.

The basic method for measuring the draw down of a well involves an operator lowering an electrical contact on a plumb bob and measuring the length thereof when contact with the water is made. As the water level changes, the operator must try to follow the change with the plumb bob. Obviously, this is very difficult to do and yields only approximations if the level is changing rapidly.

Other representative methods and devices for measuring draw down have been used in the past, however, most prior art techniques lack automaticity, or accuracy or involve multistep processes and calculations. Typical prior art approaches are found in U.S. Pat. Nos. 3,321,965 to C. R. Johnson et al; 3,780,574 to Miller; and 3,737,728 to Fitzpatrick. Many of the prior art approaches to measurements of draw down are derived from oil well drilling and measuring techniques, which are not entirely applicable to the water well industry. For the most part this is due to the fact that oil well operations generally are carried out in structural environments wherein pressures encountered in the well bore are due to geological conditions. In direct contrast, the water well environment is one in which gravity is the predominant factor, hence the measurement of draw down is done under conditions wherein the depth of a column of water is directly and linearly related to the hydrostatic pressures encountered at that depth.

SUMMARY OF THE INVENTION

Therefore it is a primary object of the present invention to provide an improved method and apparatus for measuring the draw down of water wells. The basic method comprises making a pair of in situ measurements of hydrostatic pressure heads representing the static and dynamic water table levels, and determining the draw down directly in feet from these two measurements. An extension of the basic method comprises combining the draw down measurement with water pressure and volume measurements made at the discharge port of the pumping system to yield a set of data which uniquely describes the well's character and production capability. The apparatus for carrying out the method provides for automatically performing the draw down and other measurements in a simple and efficient manner. Use is made of three pressure transducers positioned at key locations within the system to yield all of the required data in accurate, unambiguous form.

It is an object of this invention to provide a method and apparatus for measuring the draw down characteristics of a water well whereby the measuring process may be carried out continuously without the need for operator intervention, and whereby the resulting measurement provides a direct quantitative reading of the draw down in feet.

It is a further object of the present invention to provide a method and apparatus for monitoring the characteristics of a water well whereby a time history of the well is compiled as a diagnostic aid, or as an aid in scheduling production rates or maintenance intervals.

It is yet a further object of the present invention to provide apparatus for automatically monitoring water well characteristics at a site remote from the well itself.

It is still a further object of the present invention to provide apparatus for accurately and automatically measuring the water level, either static or dynamic, in a well independent of the existence of a well casing, a drill pipe, or other installed equipment.

BRIEF DESCRIPTION OF THE DRAWINGS

Additional objects and advantages of the invention will become apparent to those skilled in the art as the description proceeds with reference to the accompanying drawings wherein.

DETAILED DESCRIPTION OF THE PREFERRED EMBODIMENT

Figure 1:
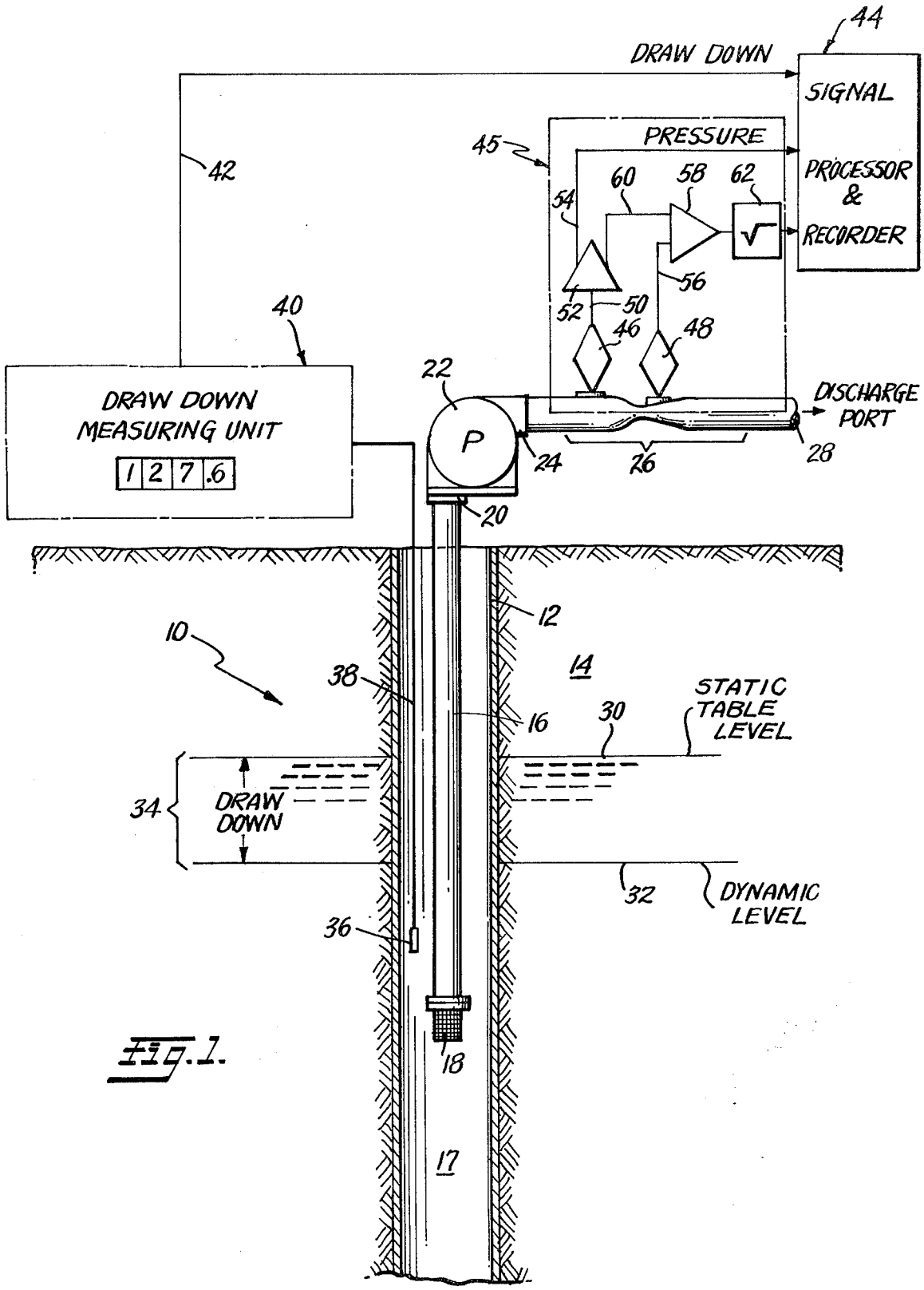
FIG. 1 is a schematic diagram of the water well monitoring system.

Referring now to FIG. 1 there is shown a schematic diagram of the water well monitoring system according to the present invention. A well is indicated generally at 10 having a casing 12 inserted into ground strata 14, and water intake tubing 16 inserted into a bore hole 17. The lower end of tubing 16 is fitted with a filter assembly 18 for guarding against the ingestion of unwanted particulate debris into the water flow. The upper end of tubing 16 is connected to an intake port 20 of a pump 22, which discharges the water produced via a discharge port 24 into a venturi section 26, and thereafter into the water distribution system via an output port 28. With the exception of the venturi 26, all of the elements described are well known and are found in virtually all water wells. It should be noted that the use of a casing, while desirable in many circumstances, is not necessarily used in water wells, and in any event plays no intrinsic part in the present invention.

Two levels of the strata 14 are of particular importance to the method of the invention. A horizontal plane indicated by a line 30 defines the upper limit of the local water table under static conditions. A second line 32 designates the location of the water table under dynamic conditions wherein the pumping system is deriving water from the well. This is referred to hereinafter as the dynamic level 32. The difference between the two levels is designated as the draw down 34, a key parameter of a well system, knowledge of which is essential for characterizing the producing capabilities of the well. To accurately and automatically monitor these two levels, a simple and portable measuring unit has been devised. A pressure transducer 36 is suspended in the bore hole by means of a flexible electrical cable 38. The upper end of the cable 38 is connected to a draw down measuring unit 40. A detailed description of the measuring unit 40 will be provided below in connection with FIG. 2. An output of the measuring unit 40 is routed via a line 42 to a first input of a signal processor and recorder 44.

A water discharge pressure and water flow measuring subsystem of the present invention, shown as the group of elements within the block 45, performs the required measurements of water pressure and water flow at the discharge end of the pumping system. Associated with the venturi 26 in the discharge section of the water path are a pair of pressure transducers 46 and 48. The transducer 46 is positioned at the inlet of venturi 26 and provides a measure of the water discharge pressure at the output of the pump 22. The transducer 48 is positioned at the throat of the venturi 26 to provide a water pressure measurement at that location. The output of transducer 46 is routed via a line 50 to an amplifier 52, and thereafter via a first output of amplifier 52 via a line 54 to a second input of the signal processor 44. The output of the transducer 48 is routed via a line 56 to a first input of an amplifier 58. A second input to the amplifier 58 is routed via a line 60 from a second output of the amplifier 52. An output from amplifier 58 is routed to a square root taking circuit 62, and thereafter to a third input of the signal processor 44. As is well known, the pressure drop across the inlet and throat sections of a venturi is proportional to the square of the flow through it. Hence, lines 60 and 56 which carry signals representing the inlet pressures and throat pressures respectively are routed to difference amplifier 58, whose output then represents the pressure difference at the two locations. Circuit 62, whose output contains the square root of the pressure differences thus provides a measure of the water flow being produced by the well.

Functionally, the water discharge pressure and water flow measuring subsystem 45 provides its two outputs to the signal processor 44, where the draw down data is also availble. These three parameters, all of which are represented by properly scaled voltages quantitatively defining their respective variables, are then recorded and further processed to provide the desired quantitative description of the well. Included within the further processing may be means for coding and impressing the three parameters, along with station identification, date and time, onto a data transmission channel — phone lines, RF or land line telemetry circuits, or the like — for routing to a central office facility.

Figure 2:
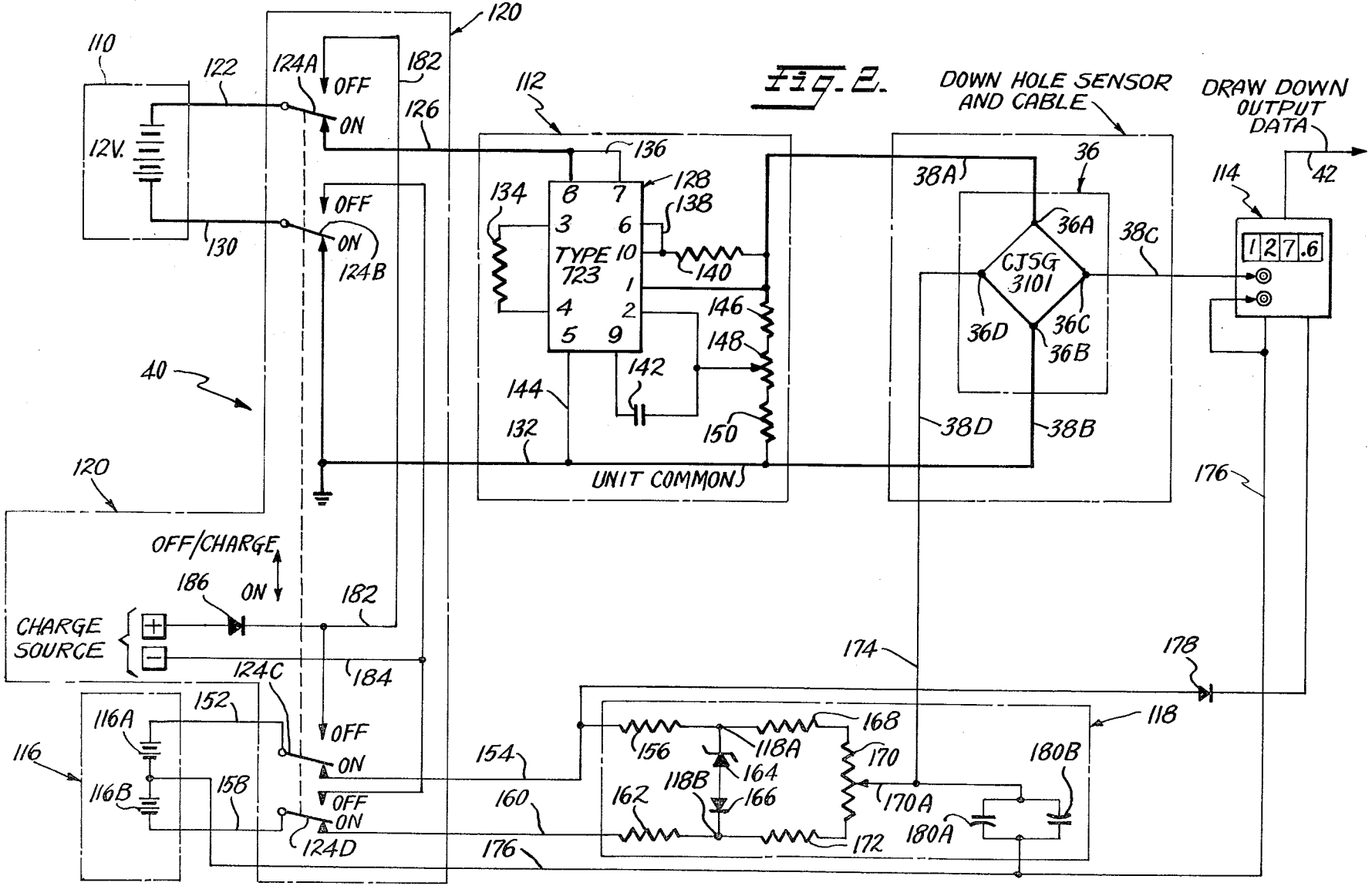
FIG. 2 is a schematic diagram showing the circuitry of the draw down measuring unit of the instant invention.

Referring now to FIG. 2 there is shown a schematic diagram of the circuitry of the draw down measuring unit 40. Briefly, a battery 110 is applied to a voltage regulating module 112, and the regulated output voltage therefrom is used to energize the piezoresistive pressure transducer 36. The output of the pressure transducer 36 is read out by a digital voltmeter 114. A second battery 116 is used to energize the digital voltmeter 114, and is further applied to a regulated, compensating network 118, whose output voltage is inserted into the transducer/voltmeter circuit to modify the voltmeter reading. A charging and switching network 120 provides for charging the batteries 110 and 116 when the measuring unit 40 is not in operation.

A line 122 connects a positive terminal of the 12 volt battery 110 to a first movable pole **124*A* of a four-pole-double-throw switch 124. For ease of description the switch 124 is shown as four electrically independent sections designated as 124*A*-124*D*, each lettered element corresponding to a movable pole portion of the respective independent section. All sections of the switch 124 are operated in unison, and are shown in the ON (measuring unit 40 operating) position. A line 126 further routes the positive battery voltage from an ON fixed contact associated with movable pole 124*A* to an input terminal 128-8 of a voltage regulator chip 128. The voltage regulator chip 128 is equivalent to the commercially available type designated as RCA 723, and provides at its output terminal 128-1, a highly regulated voltage which is adjustable by means of an external resistor network as is well known and conventional. The regulated, adjusted output voltage from 128-1 is routed via a line 38*A* to a first input node 36*A* of the pressure transducer 36. The pressure transducer 36, which is of the piezo-resistive bridge type, may be of a type equivalent to a unit available from C&J Enterprises of Tarzana, Calif. as device CJSG-3101. A line 130 connects a negative terminal of the battery 110 to a movable pole 124*B*, and thereafter via an associated ON fixed contact and a line 132 to a plurality of circuit locations. Hereinafter the line 132 will be referred to as the unit common 132. A first connection of unit common 132 is routed via a line 38*B* to a second input node 36*B* of the pressure transducer 36. The lines 38*A* and 38*B*, are part of a multiconductor cable which is used to lower the pressure transducer 36 into the well bore during actual measuring operations. The multiconductor cable had been shown more simply in FIG. 1 as the cable 38. Completing the interconnection of the voltage regulating chip 128, there is shown a resistor 134 connected between terminals 128-3 and 128-4; a jumper 136 connecting terminals 128-7 and 128-8; a jumper 138 connecting terminals 128-6 and 128-10; a resistor 140 connected between terminals 128-10 and 128-1; a capacitor 142 connected between terminals 128-2 and 128-9; and a line 144 connecting terminal 128-5 to unit common 132. A resistive voltage divider network consisting of a fixed resistor 146, a potentiometer 148 and a fixed resistor 150 are connected in series between the terminal 128-1 and the unit common 132. The wiper of potentiometer 148 is connected to the terminal 128-2. In operation, the potentiometer establishes the precise voltage produced by the voltage regulator 128 at its output terminal 128-1**, as is also conventional.

An output of pressure transducer 36 is routed via a node 36*C* and a line 38*C* to a first signal input terminal of the digital voltmeter 114. The digital voltmeter 114 may be of a type equivalent to a Weston Model 1220 device adapted to provide a remote output, either in analog or digital form, via the output line 42. A second output of pressure trannsducer 36 is routed via a node 36*D* and a line 38*D* to the compensating network 118, as will be further described below. The lines 38*C* and 38*d* complete the interconnection of pressure transducer 36 with the measuring unit 40 via the cable 38 of FIG. 1. As the pressure transducer 36 is of the bridge type, the output voltage representative of the pressure being sensed is available between the nodes 36*C* and 36*D*. Were it not for the compensating technique, to be described below in connection with the compensating network 118, the node 36*D* would normally be connected directly to a second signal input terminal of the digital voltmeter 114.

A 12 volt battery 116, which consists of two series-aiding-connected 6V batteries 116*A* and 116*B* with their junction point accessible to the external circuit, provides the power to energize the digital voltmeter and also to energize the compensating network 118. A line 152 connects a positive terminal of the battery 116A to a movable pole 124*C* and thereafter via an associated ON fixed contact and a line 154 to a resistor 156. The other end of resistor 156 is connected to a node 118A of the network 118.

A line 158 connects a negative terminal of the battery 116*B* to a movable pole 124*D* and thereafter via an associated ON fixed contact and a line 160 to a resistor 162. The other end of resistor 162 is connected to a node 118*B* of network 118. A zener diode 164 has its cathode connected to the node 118*A* and its anode connected to an anode of a diode 166. A cathode of the diode 166 is connected to the node 118*B*. Thus, there will exist across the nodes 118A and 118B a regulated voltage substantially determined by the reverse conduction of zener diode 164 and by the value of the dropping resistors 156 and 162. A resistive voltage divider network consisting of a fixed resistor 168, a potentiometer 170 and a fixed resistor 172, all of which are connected in series, is connected across the nodes 118*A* and 118*B*. A wiper 170of the potentiometer 170 provides the output of the voltage divider network via a line 174 and the line 38*D* to the node 36*D* of the pressure transducer 36. A line 176 connects a negative terminal of the battery 116*A* to a positive terminal of the battery 116*B* and further to a first power input and a second signal input terminal of the digital voltmeter 114. A further extension of the line 154 connects the positive voltage of battery 116*A* to a second power input of the digital voltmeter 114 via a series connected dropping diode 178. Thus it is seen that the digital voltmeter is powered by the 6V battery 116*A*. A pair of capacitors 180*A* and 180*B* are connected in parallel with each other with 170*A* end of the combination connected to the wiper 170of potentiometer 170, and the other end of the combination connected to the line 176. As shown, the capacitors 180*A*-180*B* are polarized types and have their oppositely polarized terminals connected so as to produce a bipolar resulting capacitance.

Effectively, the combination of the battery 116 and the compensating network 118 produces a bipolar, floating, precisely adjustable voltage which is inserted in series with the output voltage of the pressure sensor 36 and digital voltmeter 114. The voltage, hereinafter referred to as the compensating voltage, is available between the lines 174 and 176. By adjustment of the potentiometer 170, the voltage on line 174 can be made positive or negative in precisely adjustable increments around zero volts. When inserted into the transducer/-voltmeter circuit the compensating voltage may be used, as described below, to translate the voltmeter reading higher or lower to achieve operationally desirable modifications of the hydrostatic pressure readings.

The charging and switching network 120 provides for turning the measuring unit 40 ON and OFF and further for placing the 12 v batteries 110 and 116 in parallel and applying an external source for periodic recharging in the OFF condition. Typically the external source may consist of any convenient automobile electrical system, or the like, thereby permitting extended operations of the measuring unit 40 at remote field sites when required. Operating the switch 124 to the OFF position deenergizes the measuring unit 40 and places the batteries 110 and 116 in parallel. A line 182 is connected to an OFF fixed contact associated with movable pole 124*A* carrying the positive terminal of battery 110; and is also connected to an OFF fixed contact associated with movable pole 124*C* carrying the positive terminal of battery 116. The line 182 is routed via a series-connected protective diode 186 to the positive terminal (+) of the charging source connection. A line 184 is connected to an OFF fixed cotact associated with movable pole 124*B* carrying the negative terminal of battery 110; and is further connected to an OFF fixed contact associated with movable pole 124*D* carrying the negative terminal of battery 116. The line 184 is routed directly to the negative terminal (−) of the charging source connection.

Functionally, the major features of the measuring unit 40 are as follows. The pressure transducer (alternately pressure sensor) 36, which basically is required to produce two hydrostatic pressure measurements, the difference of which constitutes the desired draw down measurement, is energized by a precisely controllable, stable voltage. By proper combination of the voltage applied to the pressure transducer 36 and the intrinsic sensitivity of the pressure transducer 36, an output scale factor is obtained which is then read out on the digital voltmeter. The pressure sensor cited as an illustrative implementation, the CJSG-3101 device, was made to produce a scale factor of one millivolt change in output for each 0.433 psi change in pressure sensed, when resistors 146, 148 and 150 having respective ohmic values of 2.2k, 5k and 2.2k were used. The potentiometer 148 is adjusted to precisely compensate for the length of interconnecting cable in use, and similar circuit variables. It should be noted that the above scale factor produces a digital voltmeter reading which corresponds directly to feet of water head, and therefore the draw down measurement per se requires no further data reduction. For example — a first measurement taken on a properly calibrated system under conditions wherein no water was being removed from the well might produce a reading of 127.6 on the digital voltmeter. Disregarding for the moment the secondary effects of ambient atmospheric pressure and well site altitude, this reading indicates that the pressure sensor is 127.6 feet below the surface of the water. After starting up the well pumping system and establishing the water removal at some desired rate, a second reading of 107.6 might be noted. The draw down would be immediately known to be the difference of the two readings — 20 feet. Further, the other mentioned secondary effects would have no effect on the accuracy of the resultant drawn down measurement using this technique as they would have made the same contribution to both readings, and would therefore be washed out by the subtraction process.

While the secondary effects indicated above are negligible for measurements of draw down by the subtractive technique, it is often of value to perform certain well measurements with reference to either absolute pressure levels, or predetermined pressure levels. The use of the compensating voltage circuitry described previously allows the measuring unit 40 to accomplish these desired absolute measurements. By adjusting the compensating voltage with the aid of predetermined calibration tables of the potentiometer 170, which may be a ten turn device, the base line readings of the voltmeter may be to reflect hydrostatic pressure heads referenced to a standard, or predetermined, barometric pressure or site elevation. Also, a time series of readings of draw down may be desired all to a common barometric base so as not to mask the effects of small, long term shifts in the static water table level. An additional technique wherein the compensating voltage provides an enhanced operational capability involves setting the compensating voltage such that the voltmeter reads zero under zero well water withdrawing conditions. Thereafter, under pumping conditions, a draw down reading directly in feet would be indicated on the digital voltmeter.

Although the invention has been described in terms of selected preferred embodiments, the invention should not be deemed limited thereto, since other embodiments and modifications will readily occur to one skilled in the art. It is therefore to be understood that the appended claims are intended to cover all such modifications and changes as fall within the true spirit and scope of the invention.

What is claimed is:

1. Apparatus for monitoring liquid draw down in a well, comprising:

(a) a first assembly adapted to be lowered into the well bore, said assembly carrying pressure sensing means for sensing the hydrostatic pressure of the liquid in the well bore;

(b) said pressure sensing means comprising a piezo-resistive device, said device providing a pressure output signal;

(c) a measurement unit operatively connected to said first assembly comprising:

(i) power source means supplying an output voltage and having a regulator which regulates the output voltage of said power source means, for energizing said piezo-resistive device;

(ii) voltage modifying means connected to said piezo-resistive device for modifying the pressure output signal;

(iii) readout means connected for receiving said modified pressure output signal and providing a direct output indication of draw down.

2. The apparatus of claim 1 further comprising:

(a) means connected to said readout means for providing a first output signal corresponding to said hydrostatic pressure measurement;

(b) a second having:

(i) first measuring means for determining the volume of liquid being produced by the well;

(ii) second measuring means for determining the discharge pressure of the liquid being produced by the well;

(iii) conversion means connected to said first and second measuring for providing other output signals corresponding to said volume and discharge pressure; and (c) means connected to said measurement unit and to said second assembly for recording said first output signal and said other output signals.

3. The apparatus of claim 2 wherein the well is a producing water well and the liquid parameters measured are water parameters.

4. The apparatus of claim 3 further comprising output interface means for encoding said first and other output signals in a compatible form for telemetering said first and other output signals.

5. The apparatus of claim 3 wherein said piezo-resistive device comprises a four terminal electrically energized piezo-resistive bridge circuit.

6. The apparatus of claim 3 wherein said readout means comprises a digital display, said modified pressure output signal corresponds to a measurement in feet of water draw down and said readout means provides a display substantially directly in feet.

7. The apparatus of claim 1 wherein the well is a producing water well said modified pressure output signal corresponds to a measurement in feet of draw down and said readout means comprises a digital display means for displaying said modified pressure output signal directly in feet.

8. The apparatus of claim 7 wherein said piezo-resistive device comprises a four terminal electrically energized piezo-resistive bridge circuit.

9. The apparatus of claim 8 wherein said apparatus is portable and further comprises a flexible cable means having at least four conductors therein connected to said bridge circuit, said cable means for lowering said first assembly into said well bore.

10. The apparatus of claim 1 wherein said pressure sensing means comprises a bridge circuit having an input and an output, said bridge circuit including said piezo-resistive device and said voltage modifying means comprising:

(a) a first voltage adjusting means connected between said power source and the input of said bridge circuit for calibrating said apparatus whereby said readout means directly indicates a linear measure; and (b) a second voltage adjusting means connected between the output of said bridge circuit and said readout means for zero balancing said readout means whereby said apparatus provides a direct indication of draw down.

* * * * *